United States Patent [19]

Guerrero et al.

[11] 4,114,313

[45] Sep. 19, 1978

[54] COMBINATION DOLL AND ACCESSORY ARTICLES

[75] Inventors: Benjamin G. Guerrero, Los Angeles; Gerard K. Leistikow, San Pedro; Norman E. Sindlinger, Los Angeles, all of Calif.

[73] Assignee: Mattel, Inc., Hawthorne, Calif.

[21] Appl. No.: 761,124

[22] Filed: Jan. 21, 1977

[51] Int. Cl.[2] ..... A63H 13/18

[52] U.S. Cl. ..... 46/264; 46/118; 46/147

[58] Field of Search ..... 46/135 R, 136, 141, 46/264, 265, 117–120, 147

[56] References Cited

U.S. PATENT DOCUMENTS

| | | | |
|---|---|---|---|
| 788,110 | 4/1905 | Lehmann | 46/119 |
| 1,168,750 | 1/1916 | Schuhmann | 46/147 X |
| 1,704,914 | 3/1929 | Fairweather | 46/147 UX |
| 2,148,010 | 2/1939 | Bowers | 46/118 |
| 2,150,465 | 3/1939 | Sonheim | 46/147 |
| 2,252,290 | 8/1941 | Konikoff | 46/117 X |
| 2,288,371 | 6/1942 | Rothschild | 46/119 |
| 2,385,872 | 10/1945 | Marshall | 46/147 |
| 2,504,652 | 4/1950 | Cohn | 46/136 |
| 2,966,762 | 1/1961 | Hardaway et al. | 46/147 X |
| 3,298,129 | 1/1967 | Katz | 46/118 |
| 3,303,605 | 2/1967 | Henry | 46/118 |
| 3,465,474 | 9/1969 | Gardel et al. | 46/164 |
| 3,590,520 | 7/1971 | Tomaro | 46/147 |
| 3,680,254 | 8/1972 | Glass et al. | 46/265 |
| 3,775,900 | 12/1973 | Thorn et al. | 46/118 X |
| 3,837,113 | 9/1974 | Triska | 46/116 |
| 3,858,353 | 1/1975 | Glass et al. | 46/136 X |
| 3,922,813 | 12/1975 | Terzian et al. | 46/119 |

*Primary Examiner*—F. Barry Shay

*Attorney, Agent, or Firm*—John G. Mesaros; Max E. Shirk; Stephen L. King

[57] ABSTRACT

A combination doll and accessory article wherein the doll has a body with a neck opening having a generally hollow head connected thereto by a swivel connection, the head having a weighted mass therein, the mass including an electric motor and speed reducing gears connected to a shaft extending downwardly through the neck opening, the swivel connection being configured to permit the head along with the weighted mass therein to move in an orbital path. An article adapted to be moved to and fro, such as a swing or a cradle is provided for receiving the doll in such a position that movement of the article results in response to orbital movement of the head of the doll. A switch is provided on the interior of the doll's head adjacent the mouth thereof, the switch being normally closed and being opened in response to insertion into the mouth of a simulated pacifier or the like made of an insulating material.

13 Claims, 7 Drawing Figures

104
78
70
94
88
86
90
84
82
96
102
100
92
98
72
112
106
108
110
142
118
144
114
116
64

COMBINATION DOLL AND ACCESSORY ARTICLES

BACKGROUND OF THE INVENTION

The background of the invention will be discussed in two parts:

1. Field of the Invention

This invention relates generally to dolls, and more particularly to a combination doll and accessory article set.

2. Brief Description of the Prior Art

Dolls which have simulated human-like movements take many forms, for example, crawling, walking, dancing and the like. Such dolls are of greater fascination to children than dolls which perform no such functions.

Dolls with moving heads are likewise fascinating to children and such a bobbing head doll is shown and described in U.S. Pat. No. 3,465,474, issued Sept. 9, 1969 to R. Gardel, et al., which illustrates a doll having the head thereof moved in response to different orientations of the doll body by means of a pendulum-like counterbalance weight suspended in the body and coupled to the head to provide such movement in response to the force of gravity.

Doll and accessory items such as rocking chairs or the like, likewise provide fascination for children, one such mechanism being shown and described in U.S. Pat. No. 3,837,113, issued Sept. 24, 1974 to R. Triska in which a rocking chair is provided with a spring-wound mechanism in the rocking chair seat with a portion of the mechanism being mechanically coupled to a doll body through an operating lever actuable by the motor mechanism to effect rocking of the rocking chair. Another similar type dancing doll is shown is U.S. Pat. No. 2,504,652, issued Apr. 18, 1950 to I. Cohn which shows a standing doll mounted on a plate having the bottom surface thereof configured for rocking movement, the doll containing a spring-wound motor rotating a shaft extending outwardly from the top of the head of the doll, the outer end of the shaft having affixed thereto a wide-brimmed hat having a bangle at the brim thereof to provide an eccentric weight, so that rotation of the hat by means of the motor causes bodily rotation of the entire doll structure.

In the doll of U.S. Pat. No. 3,837,113 the mechanical coupling between the doll and the rocking chair substantially curtails the aesthetic appearance of either or both components. With respect to the doll illustrated in U.S. Pat. No. 2,504,652 the structure shown is basically a single purpose article with movable mechanical components, that is the rotating hat and bangle thereon, externally of the doll preventing the doll from being utilized in other play situations by a child.

It is accordingly an object of this invention to provide a new and improved doll and accessory article set.

It is another object of this invention to provide a doll and accessory article adapted to be moved to and fro in response to orbital movement of a weighted mass within the head of the doll.

SUMMARY OF THE INVENTION

The foregoing and other objects of the invention are accomplished by providing a doll having a body with a neck opening for receiving a complementary shaped neck portion of a hollow head, the head containing a weighted mass therein affixed to the head for movement therewith, the weighted mass including an electrically operated motor coupled to speed reduction gears for driving a shaft extending downwardly into the body of the doll, the neck opening containing a supporting structure for orbitally moving said head and weighted mass in response to rotation of said shaft, the body containing a battery electrically coupled to the motor through two switches in series connection therewith. A first switch is accessible to the child for actuation externally of the body while the second switch is normally closed and positioned in the head adjacent a mouth opening thereof, the second switch being deactivated by insertion through said mouth opening of a non-conductive article simulating a pacifier or bottle. An article, such as a rocking chair, a cradle or a swing, all of which are adapted to be moved to and fro in response to the shifting of weight thereon is provided, the article being configured to receive the doll in such a position that movement of the article is effected in response to orbital movement of the weighted mass relative to the doll body.

Other objects, features and advantages of the invention will become apparent upon a reading of the specification when taken in conjunction with the drawings in which like reference characters refer to like elements in the several views.

DESCRIPTION OF THE PREFERRED EMBODIMENT

Figure 1:
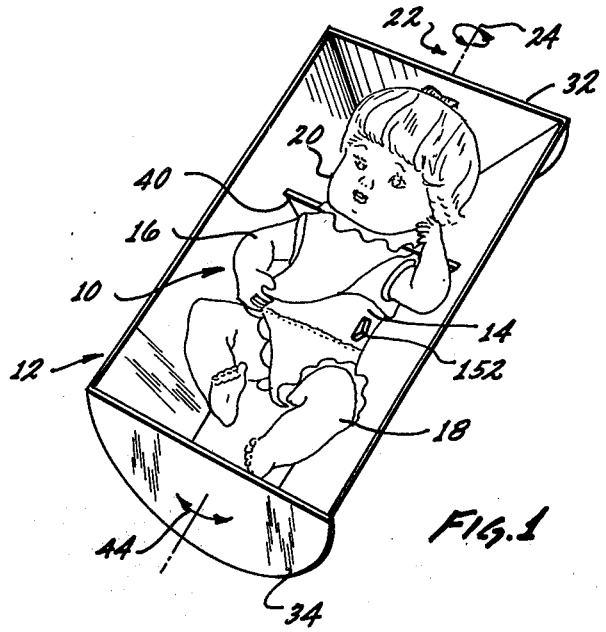
FIG. 1 is a perspective view showing the doll and accessory article for use therewith, the article being configured in the form of a cradle.
Figure 2:
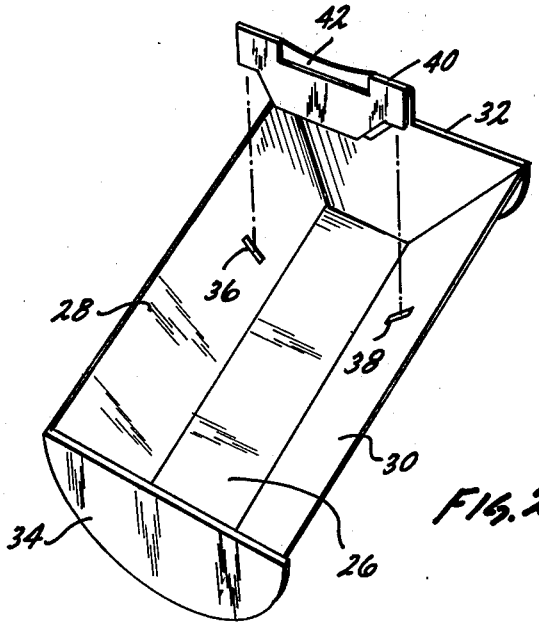
FIG. 2 is an exploded perspective view of the cradle shown in FIG. 1.

Referring now to the drawings and particularly to FIG. 1 there is shown a doll 10 reclining within an accessory article configured in the form of a cradle 12, the doll 10 having a body 14 with arms 16 and legs 18 secured thereto in conventional fashion. The doll is provided with a head 20 which, as will hereinafter be discussed, is adapted to rotate relative to the body 14 in an orbital path as indicated by the closed loop generally designated 22 adjacent the head 20 thereof, the orbital path 22 being generally about the longitudinal center line, designated 24, of the doll 10. The cradle 12, as also illustrated in FIG. 2, has a longitudinally extending base 26 which receives the body of the doll 10, with sidewalls 28 and 30 diverging upwardly from the base 26. Extending transversely to the base 26 at either end thereof are end portions 32 and 34 having the lower edges thereof arcuately configured to form rockers. The sidewalls 28 and 30 are provided with slots 36 and 38 respectively for receiving therein a neck-supporting member 40 in spaced relation and close to end rocker 32. The neck-supporting member 40 has a slightly cutaway portion 42 for receiving the neck portion of the doll 10 therein, the neck-supporting member 40 being configured and dimensioned so that with the doll 10 positioned therein as indicated in FIG. 1, the body 14 remains stationary with respect to the cradle 12 and the head 20 is free to rotate within the cradle but spaced from adjacent surfaces of the cradle 10 during the movement of the head 20. As will hereinafter be discussed the head 20 is provided with a weighted mass therein orbiting along the path designated 22 with respect to the longitudinal center line 24, thereby causing the cradle 12 to rock along the arc, designated 44 and swing to and fro along the arc 44 in response to the shifting of the weighted mass within the head 20 on either side of the longitudinal center line 24.

Figure 3:
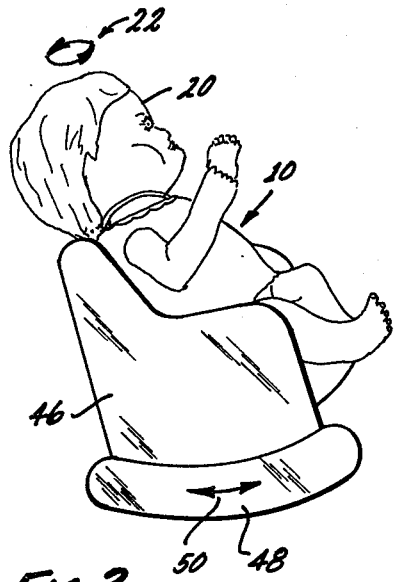
FIG. 3 is a perspective view of the doll positioned in an accessory article configured in the form of a rocking chair.

As shown in FIG. 3 the article to be used as an accessory for the doll 10 can also be configured in the form of a rocking chair 46 having a pair of rockers 48 at the lower end thereof adapted for engaging a surface. The rocking chair 46 is provided with a suitable seat for receiving the doll 10 in an upright or seated position. The positioning of the seat with respect to the curve of the rockers 48 is such that, with the head 20 of the doll 10 positioned vertically with respect to its longitudinal center axis, the contact point of the rocker 48 with its engaged surface is generally in a plane perpendicular to the drawing surface and parallel to and slightly rearwardly of the longitudinal center axis of the doll 10. The dimensioning of the rockers 48 and the seat of the rocking chair 46 is preferably selected to permit the doll 10 to sit in the rocking chair 46 in a generally upright seating position as shown with the overall weight being slightly toward the back of the rocking chair 46 so that when the doll head 20 rotates in the orbital path 22 the rocking of the chair 46 as indicated by the double-ended arrow 50 permits the doll 10 to rock without tipping forward resulting in unaided rocking movement of the rocking chair 46.

Although not shown, the doll 10 can also be utilized in conjunction with an article configured in the form of a baby swing of the cloth seat or fixed seat type wherein the movement to and fro in response to the shifting of the weighted mass is a swinging movement from a fixed pivot axis suitably supported by a framework. Similarly, as with articles having rockers, the doll receiving portion of the swing is configured and dimensioned so that the suspension of the doll therein results in to and fro movement of the swing during movement of the head 20 of the doll 10 in an orbital path.

Figure 4:
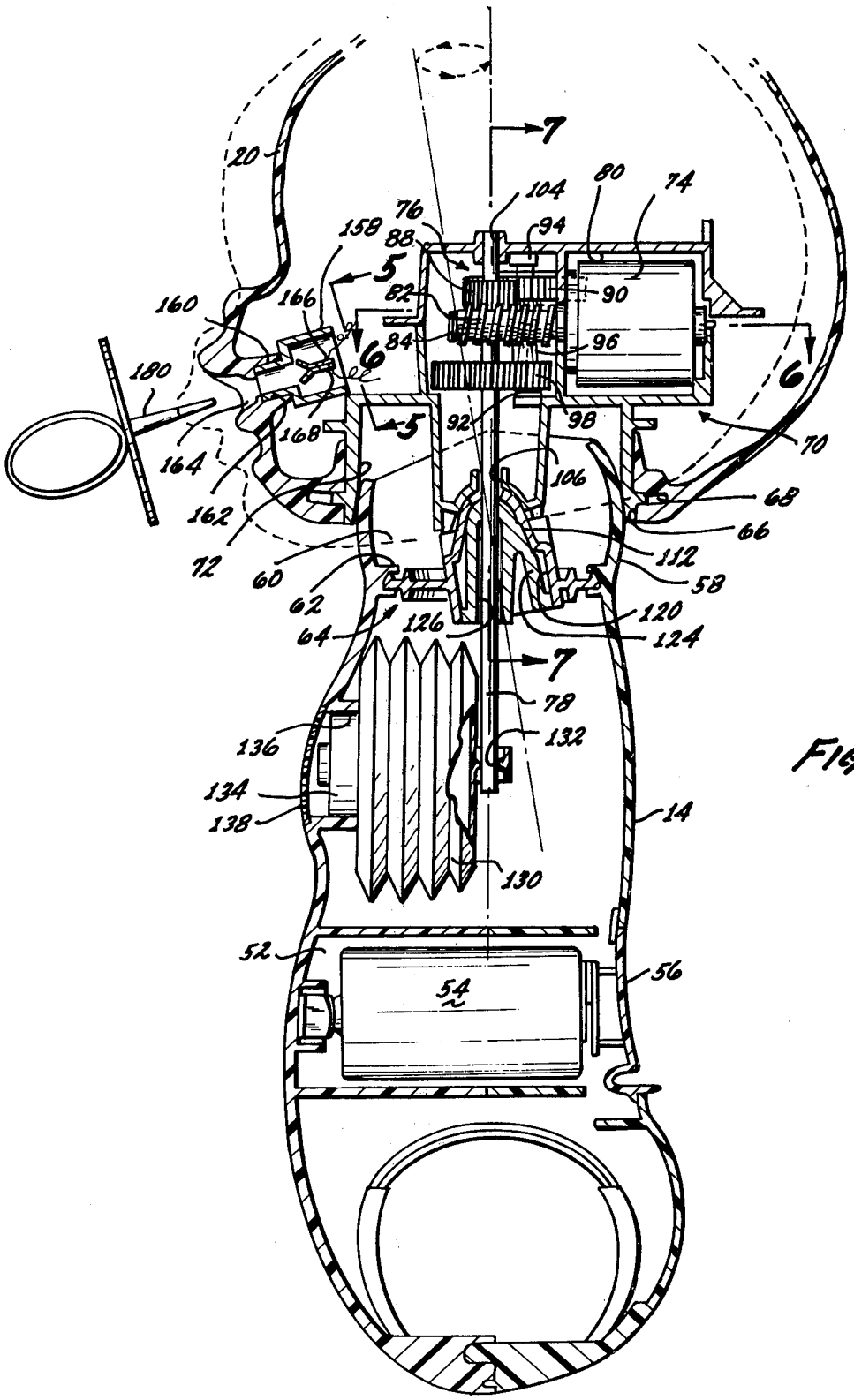
FIG. 4 is a cross sectional view of the torso and head of the doll of FIG. 1 along a front to back plane.

Referring now to FIG. 4 the torso 14 of the doll 10 is generally hollow and adjacent the lower portion thereof has a battery receiving compartment 52 for receiving therein a suitable battery 54. The compartment 52 is accessible by means of a suitably hinged cover 56 on the back of the torso 14, the cover 56 being configured to conform generally to the contour of the back of the torso 14. The upper end of the torso 14 has an integrally formed hollow neck 58 which has a spherically contoured surface, the upper end of neck portion 58 being open to provide a neck opening 60. The neck opening 60 has an integrally formed inwardly extending annular portion 62 configured for frictionally receiving therein a mounting member 64 which, as will hereinafter be discussed, effects the connection of the head 20 to the body 14.

The head 20 is hollow and has an opening 66 in the bottom thereof, the opening 66 being provided with a circumferentially disposed recess 68 for receiving therein a supporting framework generally designated 70 having a downwardly extending cylindrical sleeve portion 72 with the lower edges there tapered outwardly for mating engagement with the spherically contoured neck portion 58, thereby forming a swivel connection between the head 20 and the body 14. The framework 70 is configured to support a weighted mass which includes an electrically operated D.C. motor 74 and a speed reduction gearing arrangement generally designated 76 adapted to rotate a vertically extending shaft 78, which in the solid line position shown in FIG. 4 is on the vertical or longitudinal center axis of the body 14 of the doll 10.

The motor 74 is fitted within a suitably configured receptacle 80 formed within framework 70 so that the shaft of motor 74, carrys a suitable endless screw or worm 82 on a line generally perpendicular to shaft 78, the worm 82 coacting with a worm wheel 84 (see also FIGS. 6 and 7), the worm wheel 84 having the aperture 86 thereof encircling shaft 78 for rotation independent of shaft 78. Integral with worm wheel 84 is a reduced diameter pinion gear segment 88 having the gear teeth thereof engaging a larger diameter intermediate gear 90 secured for rotation within framework 70 by means of bearing projections 92 and 94 formed integrally therein. The intermediate gear 90 is provided with a reduced diameter second pinion portion 96 meshing with the gear teeth of a drive gear 98 secured to shaft 78 for driving the same. As better illustrated in FIG. 7, the drive gear 98 is provided with an upwardly extending cylindrical sleeve portion 100 loosely engaging a matingly configured annular recess 102 formed in the lower portion of worm wheel 84 to provide a bearing support for drive gear 98.

In operation, the speed of the motor 74 is suitably stepped down so that the drive shaft 78 rotates at a fraction of the speed of the motor 74 due to the intermediate speed reduction gearing accomplished through worm wheel 84 and intermediate gear 90 to drive gear 98. The final speed of rotation of shaft 78 is selected to provide an orbital movement of the head 20 at a speed consistent to simulate that of an infant's head movement when the infant is discomforted or crying. The selection of appropriate gear diameters and numbers of gears is selected to accomplish this result and correlated to the speed of operation of the motor 74.

The portion of framework 70 which receives shaft 78 has an upper bearing aperture 104 and a lower bearing aperture 106 centrally disposed in a generally cup-shaped portion 108 of framework 70 the portion 108 having the bottom surface thereof configured to form a socket 110 which coacts with a matingly configured upwardly extending ball-shaped contoured portion 112 of mounting member 64.

Figure 7:
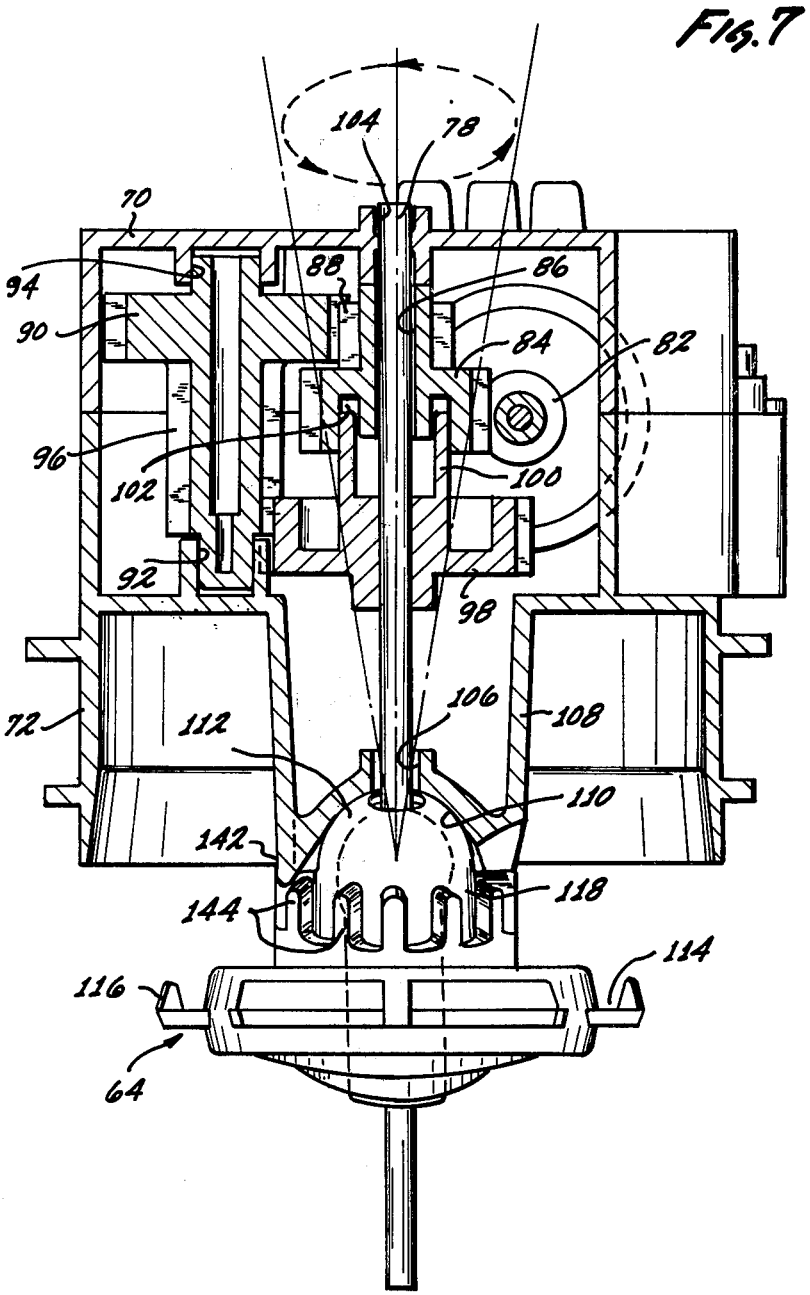
FIG. 7 is a cross sectional view of the mechanical drive assembly taken along line 7—7 of FIG. 4.

Referring to FIGS. 4 and 7, details of the connection of the head 20 to the body 14 will be discussed. As can be seen, the mounting member 64 is of one piece molded plastic construction having an outer circular flange 114 provided at its periphery with a plurality of upwardly extending positioning tabs 116 adapted to be received in fixed positional relation within mating female recesses formed in the annular portion 62 inwardly extending at the bottom of neck portion 58 of body 14. Formed centrally within mounting member 64 is a generally bell-shaped shell portion 118 having the upper end thereof configured to form the ball 112. As better illustrated in FIG. 4 the interior lower surface of shell portion 118 forms a circular bearing surface 120, the center of the circle of the bearing surface along with, of course, the axis of the shell portion 118 is positioned at an angle to the longitudinal center axis of the doll 10, the longitudinal center axis corresponding to the position of shaft 78 shown in FIG. 4. Received within shell portion 118 is a matingly configured eccentric bearing member 124 having the lower edge configured to rotatably engage the adjacent bearing surface 120. The bearing member 124 is provided with a longitudinally extending aperture 126 through which shaft 78 extends with shaft 78 being secured to bearing 124. As can be seen in FIG. 4, the axis of aperture 126 is offset a predetermined angle from the center of the circle of the bearing surface of the eccentric bearing member 124. The shaft 78 extends downwardly from bearing member 124 where the lower end thereof engages one end of a bellows 130 by means of a suitable eyelet 132 formed integrally in one surface of bellows 130. The other end of bellows 130 has a reduced diameter relatively rigid cylindrical portion 134 which is secured within a mating recess 136 formed on the interior of body 14, the outer portion of the body 14 defined by the perimeter of the recess 136 containing a plurality of apertures to form a sound transmitting section 138. The portion 134 of bellows 130 contains a suitable diatonic reed mechanism to emit sound in response to actuation of the bellows 130 during orbital movement of the head 20.

With the motor 74 appropriately energized the speed reduction gearing arrangement 76 rotates shaft 78 along with eccentric bearing member 124 within the stationary bearing surface 120 of the mounting member 64 thereby moving shaft 78 along with the weighted mass within head 20 in an orbital path resulting in pivoting of shaft 78 about mounting member 64 to the broken line position indicated in FIG. 4 resulting in forward movement of head 20 to the dotted line position with shaft 78 position being indicated in dashed lines. As the head 20 moves forward, the bellows 130 is operated in the reverse direction to take in air resulting in actuation of the reed mechanism therein. As the shaft 78 returns to its solid line position, the bellows 130 is depressed thereby emitting air through the reed mechanism. The slot contained within eyelet 132 is elongate in the plane of the adjacent bellows surface to accomodate side-to-side movement of the lower end of shaft 78 during the orbiting movement.

During this movement, the cylindrical sleeve portion 72 of framework 70 is sliding over the spherically contoured surface of neck portion 58 while the socket 110 formed in the bottom of cup-shaped portion 108 of framework 70 is sliding over ball 112 formed in the shell portion 118 of mounting member 64, thus providing two rather broad surfaces of support for the head 20 during the orbital movement thereof.

As illustrated in FIG. 7, the configuration of eccentric bearing member 124 rotating within the bearing surface 120 of shell portion 118 generates a side-to-side orbital path as defined by the upwardly diverging dashed lines on either side of shaft 78 with the broken arrows therebetween defining the orbital path of the weighted mass and, of course, the head 20. As can be seen also in FIG. 7, the outer surface of cup-shaped portion 108 of framework 70 is provided with gear surface formed from downwardly extending gear projections 142 with the outer surface of shell portion 118 having a gear surface formed of a plurality of upwardly extending mating gear projections 144 positioned peripherally about the surface thereof extending in an axial direction. During orbital movement of the framework 70, the mounting member 64 along with its integral shell portion 118 is stationary resulting in the gear projections 142 of framework 70 matingly engaging a portion of gear projections 144. Since the plane formed by the upper edges of gear projections 144 is displaced from the plane formed by the lower edges of gear projections 142, the meshing of the gear projections will encompass less than one-half the total number of such projections during orbital movement. The meshed gear arrangement supports and guides framework 70 during movement of the head 20.

Figure 6:
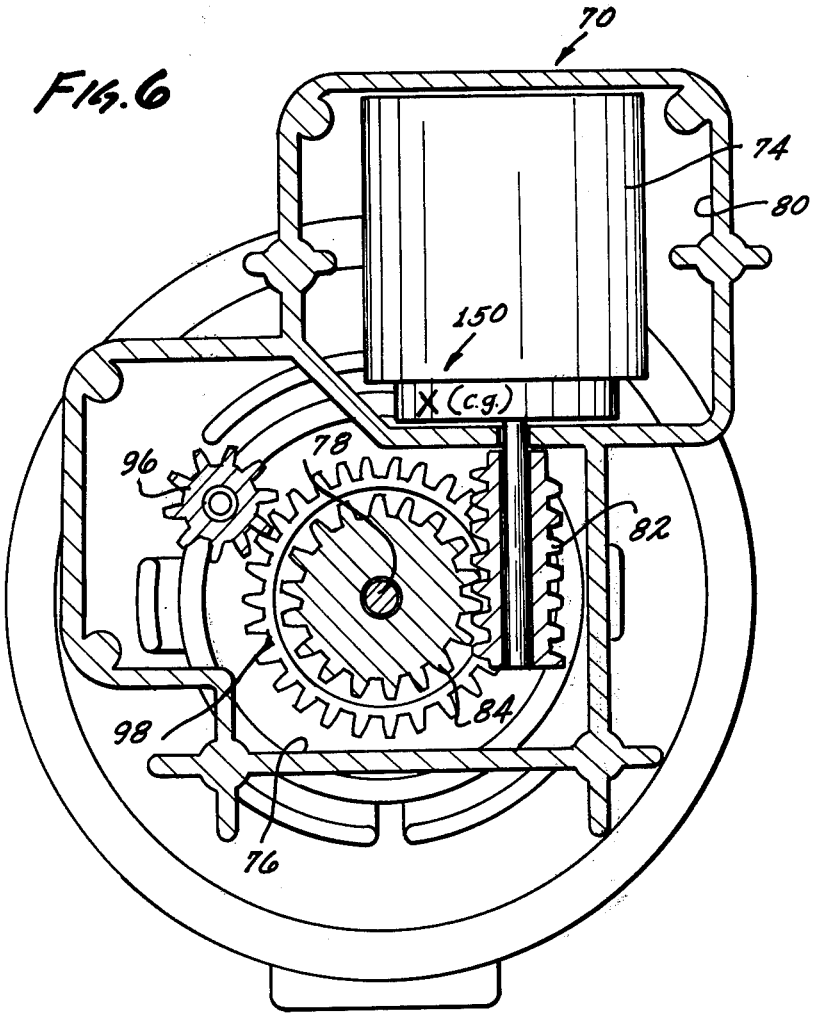
FIG. 6 is a cross sectional view of the motor and gear means in the head of the doll taken along line 6—6 of FIG. 4.

Referring to FIGS. 4 and 6, it can be seen that the weighted mass within head 20 would include the total weight of the mechanical components therein which essentially comprise the supporting framework 70, the motor 74, the speed reduction gearing arrangement 76 and a portion of the weight of the shaft 78. Of these components, depending on the selection of materials, ordinarily the motor 74 would comprise the largest item of weighted mass, and as shown in FIG. 6 a "X" is indicated and designated by the numeral 150, the "X" corresponding to the approximate center of gravity of the weighted mass, the position shown being generally rearwardly of the longitudinal center of axis of the doll 10 defined by shaft 78 and slightly to the right thereof. In any event, the path of orbital movement of the weighted mass, and the configuration of the article to be used with the doll 10 is such to effect a shifting of the center of gravity or center of mass 150 about either side of the longitudinal center axis of the doll 10 to result in to and fro movement of the article in response to orbital movement of the head 20 of the doll 10.

Figure 5:
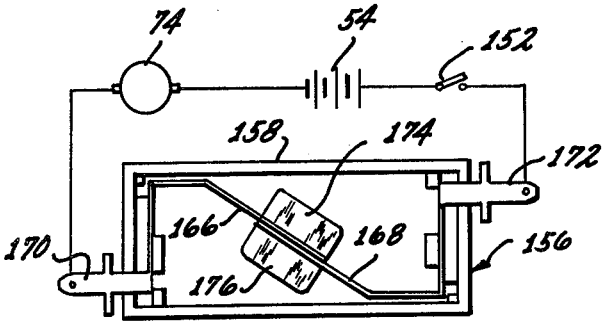
FIG. 5 is a plan view of a switch used in the doll taken generally along line 5—5 in FIG. 4, the switch being illustrated in schematic connection with the other switch, motor and battery.

Referring now to FIGS. 1, 4 and 5 the details relating to energization of the motor 74 will be discussed. Basically the motor 74 is in series circuit (see FIG. 5) with the battery 54, a first switch 152 and a second switch generally designated 156, resulting in a requirement that both switches be in the actuated or closed position before current is applied from battery 54 to the motor 74. Referring to FIG. 1, the switch 152 accessible externally of the doll 10 can be, for example, a rocker switch 152 shown in the side of the body 14 of the doll 10. The size of the switch is generally selected so as not to be obtrusive or to destroy the aesthetic appearance of the doll, and is located in such a position that with the clothing on the doll body 14 the switch would ordinarily be concealed yet be operable without a need for rearrangement in the clothing. The second switch 156 is encased in a framework 158 (see FIGS. 4 and 5) which is generally box-shaped with a reduced cross section cylindrical sleeve portion 160 adapated to be inserted into a mating recess 162 formed on the interior of the head 20 of the doll 10 in axial alignment with the mouth opening 164 thereof. The switch 156 includes first and second electrically conductive spring contacts 166 and 168 terminating in contact prongs 170 and 172 respectively adjacent the edge of, or externally of framework 158. The contacts 166 and 168 are provided with outwardly diverging integral tab portions 174 and 176 respectively which, as viewed in FIG. 4, effect a V-shaped guideway. The contacts 166 and 168 are normally biased to abut against each other to form a normally closed switch 156, the contacts 166 and 168 being resiliently separable to open the switch 156 thereby deenergize motor 74. The separation of contacts 166 and 168 is effected by the insertion into the mouth opening 164 of the doll head 20 of an accessory item such as a simulated pacifier 180 which has the "nipple" end thereof tapered and configured to be inserted into the mouth opening 164 through the opening of portion 160 of framework 158 to be guided by the V-shaped guideway formed by tabs 174 and 176 to thereby separate electrical contacts 166 and 168 of switch 156.

Consequently, to operate the doll, without the pacifier 180 inserted into the mouth opening 164, a child depresses switch 152 thereby closing it, and with switch 156 normally closed a series circuit is completed allowing current from battery 54 to energize motor 74 thereby resulting in orbital movement of the head 20 of the doll 10. The mechanical linkage of the shaft 78 to the bellows mechanism 130 results in a sound simulating an infant crying with a simultaneous orbital movement of the head 20 to give the realistic appearance of an infant crying along with the crying sound. In order to appease the "infant" the child can then utilize the pacifier 180 (or a simulated nursing bottle having a similarly configured "nipple") and to separate the contacts 166 and 168 thereby resulting in a de-energization of motor 74, notwithstanding switch 152 still being in the closed position. By the utilization of the structure shown the doll 10 can be used by itself to provide amusement to a child who desires to imitate a mother-infant relationship. By placing the doll in the cradle 12 with the neck portion 58 of the body 14 received in the cutaway portion 42 of the neck-supporting member 40, the child can then actuate switch 152 resulting in a rocking or to and fro movement of cradle 12 with the head 20 moving in its orbital path to simulate a discomforted infant. The use of the doll 10 with the accessory article 12 provides additional fascination for the child, and similarly the doll 10 can be quieted by the insertion into the mouth opening of a pacifier or nursing bottle.

Thus, with the combination doll and accessory article set shown and described a child can utilize the doll by itself, perhaps covered with a receiving blanket, or the child can use the doll with a cradle, a rocker, or a swing, any of which are adapted to be moved to and fro either by swinging or rocking through some angle wherein the orbital movement of the weighted mass within the head generates a shifting of weight in response to which the so used article is moved without child-operator assistance. Furthermore with the construction utilized all moving components are contained within the contours of the doll and body thus eliminating moving parts externally of the doll which might result in hazards to a child user. The cradle 12 shown and described herein can be, for example, of a folded cardboard construction which would serve to double as a package when covered by a cellophane or plastic composition enabling one to view the doll through the clear package. While there has been shown and described a preferred embodiment, it is to be understood that various other adaptations and modifications may be made within the sphere and scope of the invention, and the construction shown is intended to be illustrative and by way of example and is not intended to be limiting.

What is claimed is:

1. In a toy, the combination comprising:

a doll having a generally hollow head and a body having a neck portion with a neck opening, the outer periphery of said neck portion having a spherically contoured surface for engaging a matingly configured opening in said head to provide a swivel connection;

a weighted mass fixedly mounted within said head;

means mounted in said body adjacent said neck opening for mounting said weighted mass for rotation relative to said neck opening;

means within at least one of said body and head operatively coupled to said mounting means for rotating said head in an orbital path with respect to said body; and an article adapted to be moved to and fro with respect to a support therefor in response to a shifting weight on said article, said article including means configured for receiving the body of said doll and maintaining it with the head thereof spaced from surfaces of said article for permitting orbital movement of said head for moving said article to and fro in response to said orbital movement.

2. The combination according to claim 1 wherein said article has rocker members.

3. The combination according to claim 2 wherein said article is a rocking chair.

4. The combination according to claim 1 wherein said article is a swing.

5. The combination according to claim 1 wherein said article is a cradle having means for supporting said neck portion with said head spaced from adjacent surfaces of said cradle during movement thereof.

6. The combination according to claim 1 wherein said mounting means includes a mounting member secured within said neck opening, said mounting member having a bearing portion formed therein, said means for rotating said mass including a shaft coacting with said mass, said shaft being secured to an eccentric bearing member rotatably received within the bearing portion of said mounting member.

7. The combination according to claim 6 wherein said weighted mass includes an electrically operated motor operatively coupled to said shaft and said means for rotating said mass includes said motor, there being a battery mounted within said body electrically coupled to said motor through switch means for selective energization of said motor.

8. The combination according to claim 7 wherein said motor is coupled to said shaft through speed reduction gears.

9. The combination according to claim 8 wherein said head has a framework mounted therein and said motor, speed reduction gears and a portion of said shaft are operatively secured to said framework.

10. The combination according to claim 9 wherein said bearing portion of said mounting member has a partially ball-shaped portion extending toward said head and said framework has a socket portion in swivel engagement therewith.

11. The combination according to claim 10 wherein said body further includes a bellows-operated reed mechanism secure therein and said shaft extends into said body and is operatively coupled to the bellows of said mechanism for actuating said bellows in response to orbital movement of said shaft.

12. The combination according to claim 11 wherein said framework is provided with gear projections extending toward said body adjacent said socket and said bearing portion of said mounting member is provided with matingly coacting gear projections, the meshing of said gear projections guiding said head about the periphery thereof extending toward said head, during movement thereof.

13. In a toy, the combination comprising:

a doll having a body with a neck opening and a generally hollow head with a complementary portion matingly engaging said body adjacent said neck opening;

a weighted mass fixedly mounted within said head;

means mounted in said body adjacent said neck opening for mounting said head for rotation relative to said neck opening;

means within at least one of said body and head operatively coupled to said mounting means for rotating said head in an orbital path with respect to said body; and a cradle adapted to be moved to and fro with respect to a support therefor in response to a shifting weight on said cradle, said cradle having means therein for receiving and supporting the body of said doll with the head thereof in spaced relation from surfaces within said cradle for permitting orbital movement of said head and for causing to and fro movement of said cradle in response to the orbital movement of said head.

* * * * *